US009052162B1

(12) United States Patent
Shoemaker, Jr.

(10) Patent No.: US 9,052,162 B1
(45) Date of Patent: Jun. 9, 2015

(54) INDOOR LONG RANGE SHOOTING GALLERY

(71) Applicant: Stephen P. Shoemaker, Jr., Redondo Beach, CA (US)

(72) Inventor: Stephen P. Shoemaker, Jr., Redondo Beach, CA (US)

( * ) Notice: Subject to any disclaimer, the term of this patent is extended or adjusted under 35 U.S.C. 154(b) by 0 days.

(21) Appl. No.: 14/290,079

(22) Filed: May 29, 2014

(51) Int. Cl.
*A63F 13/04* (2006.01)
*F41G 3/26* (2006.01)

(52) U.S. Cl.
CPC ..... *F41G 3/2655* (2013.01)

(58) Field of Classification Search
USPC ..... 463/5
See application file for complete search history.

(56) References Cited

U.S. PATENT DOCUMENTS

| | | | | |
|---|---|---|---|---|
| 2007/0274353 | A1* | 11/2007 | Hauck et al. | 372/9 |
| 2013/0122471 | A1* | 5/2013 | Yach et al. | 434/22 |
| 2014/0134574 | A1* | 5/2014 | Yach et al. | 434/22 |
| 2015/0010887 | A1* | 1/2015 | Foege | 434/21 |

* cited by examiner

*Primary Examiner* — Pierre E Elisca
(74) *Attorney, Agent, or Firm* — Fulwider Patton LLP

(57) ABSTRACT

An amusement-type shooting gallery operates using a laser incorporated into a gun, that can be used to strike distant targets within the gallery. A gun emitting a short pulse laser is aimed at a target, which includes sensors for registering a hit. The sensor on the target can be a photovoltaic sensor that sends an electrical signal when impinged by the pulse laser, and the signal can be received by a local processor. The processor can be connected to the gun by a larger network, so that the coupling between the actuation of the trigger and the striking of the target can be coupled. A network with a display is coupled to the target and gun, enabling display of the results of the shooting operation.

10 Claims, 2 Drawing Sheets

INDOOR LONG RANGE SHOOTING GALLERY

BACKGROUND

Shooting galleries are common place in certain arcades and amusement parks. Many of these shooting galleries use various means to effect a target, including puffs of air, light, projectiles, etc. in order to implement the game. Because these means are strictly short range, shooting galleries tend to be in the five to ten meter range which is fine for certain patrons, but others long for more realistic action. There are no current long range shooting galleries for arcade type games where players can take aim and shoot across long distances. The present invention seeks to address this need.

SUMMARY OF THE INVENTION

The present invention is directed to a long range indoor shooting gallery for arcades, amusement parks, and the like, wherein players can shoot across fifty meters or more at targets using realistic guns. The arcade of the present invention, which can be operated over, for example, large indoor spaces such as bowling alleys, indoor batting cages, laser tag mazes, and other large area indoor amusement facilities, simulates sniper situations, hunting scenarios, warfare operations, and a host of other exciting possibilities heretofore unavailable to the amusement facility shooting galleries.

In a preferred embodiment, the shooting gallery would operate using a laser incorporated into a gun, that would be able to hit distant targets within the indoor shooting gallery. Mirrors could also be used to extend the distance and the difficulty where space is limited, but preferably the gallery would be incorporated into large existing indoor facilities such as arcades, bowling alleys, movie theater balconies, and the like. A gun emitting a short pulse laser is aimed at a target, which includes sensors for registering a hit. The sensor on the target can be a photovoltaic sensor that sends an electrical signal when impinged by the pulse laser, and the signal can be received by a local processor. The processor can be connected to the gun by a larger network, so that the coupling between the actuation of the trigger and the striking of the target can be coupled. In certain alternate embodiments, each gun can operate at a slighting different frequency that can be read by the targets, coupling the gun to the successful shot. Sensors that perceive the laser frequency communicate with the network to link the gun with the target.

Targets can be various objects, such as traditional targets (tin cans, bulls eyes, simulated fowl or game, bottles, etc.), or they can be simulated warfare targets used in war games scenarios. In the former, successful shots can be followed by audio responses (a tin can clangs, bottle breaking sound effects), visual responses (a target breaks apart, an enemy dies, etc.), or a combination of the two. A large scoreboard may be preferably in a conspicuous location visible by the shooters and capable of scoring for individual or team play, although scores can also be kept on player consoles or hand held units carried by the players and communicating with the network via wireless signals. Lasers allow the game to be played across large distances that otherwise would be futile for traditional shooting galleries. Low energy, non-thermal lasers that emit a beam pulse are safe and cost-effective for such an application. This allows the space between the player/gun and the target to be used for other purposes, making the concept financially feasible. Otherwise, the cost of the square foot area needed for such an enterprise would be too prohibitive to implement commercially.

In a preferred embodiment, a safety measure is implemented to ensure the safety of those below in the firing area. The safety measure in one such embodiment is a precondition that the gun is aimed within a larger, safety circle about the target or the gun will not fire its pulse laser. That is, a communication between the gun and the target indicates whether the gun is pointed in a prescribed area about the target, otherwise the gun will not fire and thus cannot be aimed or accidently fired at anything other than the intended target. For example, the target may emit a light or electromagnetic signal that is captured by a receiver on the gun when the gun is aimed at the target. Only after receiving the electromagnetic signal will the gun fire, rendering it ineffective unless pointed in the vicinity of the target. Such a safety mechanism is particularly advantageous in heavily populated space, such as an arcade or bowling alley. Alternatively, the gun may fire in that the gun simulates a fire, but the laser does not actuate. The player feels the gun shoot, hears the gun sound effects, but the laser does not emit its beam and the shot is recorded as a "miss." This prevents any danger to a bystander getting the hurt by the laser.

These advantages and other benefits of the present invention will be understood best with reference to the detailed description of the preferred invention, along with the accompanying drawings.

DETAILED DESCRIPTION OF THE PREFERRED EMBODIMENTS

Figure 1:
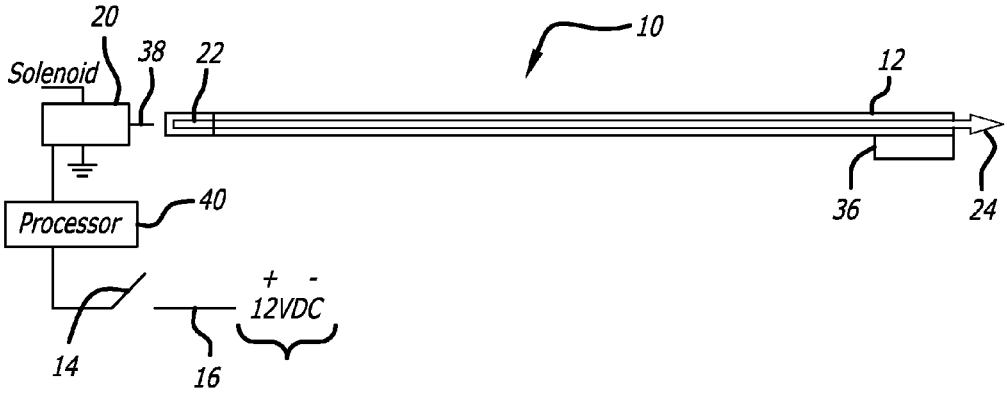
FIG. 1 is a schematic of a first preferred embodiment of the present invention.

A long range shooting gallery designed for indoor use can be achieved in a number of different ways. FIG. 1 illustrates a schematic of a first embodiment of a gun 10 having a barrel 12 and a trigger 14. The trigger 14 is part of an electrical switch 16 that connects to a DC voltage 18, such that actuating the trigger 14 makes contact with and completes the switch 16, closing the circuit with the voltage supply 18 to power the gun 10. The gun 10 can include a solenoid 20 as shown, which when charged by the voltage supply 18 causes a laser 22 to emit a laser pulse 24 through the barrel 12 and toward a target. If the target is hit, a signal would be sent to the player in one of several forms such as an audio signal (simulated contact of projectile with target), visual signal (target illuminated, simulated explosion of target, scoreboard incremented, or other audio/visual indicator). Depending upon the strength of the laser, the shot can be taken from one side of a room or building to a target on the opposite side, or the target may be located vertically displaced from the shooter at a significant altitude. This allows the space between the gun 10 and target to be used for virtually any purpose. The shooting gallery of the present invention can utilize underused overhead square footage, shooting over good square footage like arcade floor space or bowling lanes, thus the cost per square foot of the shooting gallery is minimal.

Other alternatives are available to trigger the laser, such as those described in https//:www.laser-ammo.com and http://www.laserlyte.com. The light or signal emitting from the target need not be a laser. For example, a pulse LED could be used with visual light, or infrared light. The pulse can also be coded so that the laser receiver would interpret that the target is in sight and not just another light source.

Figure 2:
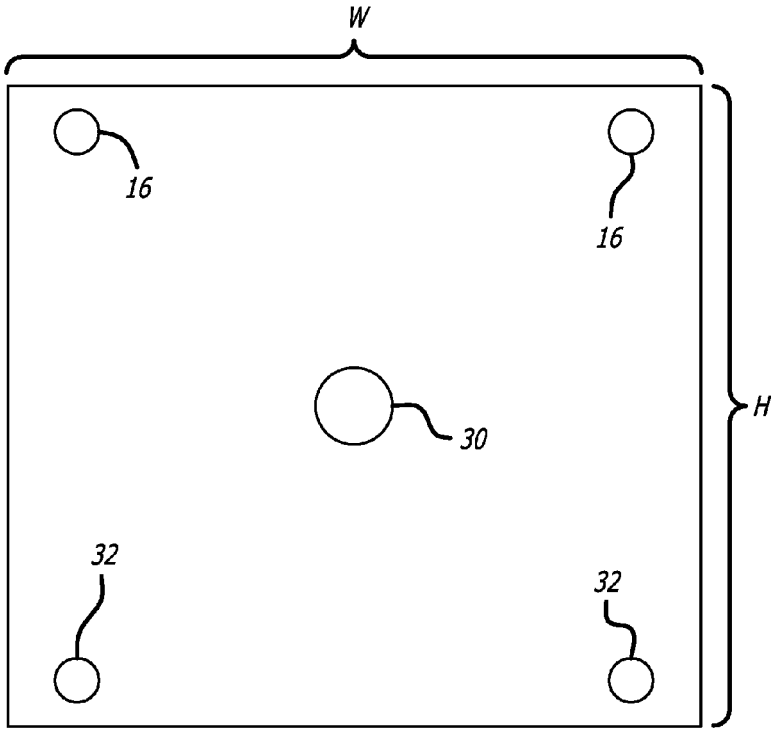
FIG. 2 is a schematic of the target and emitter combination of the present invention.

Although the laser 22 is a low energy, non-thermal device, and therefore not dangerous, protection to other patrons is afforded through communication between target and gun 10. FIG. 2 illustrates a schematic of a target 30 used in conjunction with the present invention. The target 30 is surrounded by several infrared emitters 32 that are pulsed with some code, sequence, or frequency. In a preferred embodiment, the shooter aiming the gun 10 at the target 30 has to be pointing near the target 30 so that a receiver 36 attached to the gun's barrel 12 receives the emitters' pulse signal. The area (H×W) of operation for which the gun will fire is larger than the target 30, and the trigger 14 will only work if the gun is pointed within this area. The laser pulse 24 goes from the gun barrel 12 to the target 30 with much more control so that the gun will work but hitting the target requires more accuracy. The gun will not fire unless it is pointed at the infrared emitters.

There are many ways to fire the laser. One method is a bullet sized enclosure with a pulse laser, such as those available from http://www.laserlyte.com/ among others. A cartridge 22 in the gun 10 includes the electronic solenoid 20 that pushes a pin 38 into the laser cartridge 22 much like a firing pin. The electrical current to the solenoid 20 may be controlled by the electronic circuit, the completion of which depends on whether the gun 10 is pointed at the infrared emitters. If the gun 10 is correctly aimed at the target 30, the receiver 36 would close the circuit at the switch 16 or some other location, allowing the solenoid 20 to actuate when the trigger 14 is pulled. The actuation of the solenoid 20 drives the pin 38 into the laser cartridge 22, causing the laser to pulse toward the target. There are other ways of determining whether the gun 10 is aimed correctly, such as location but ultraviolet seems practical as does the laser system.

Figure 3:
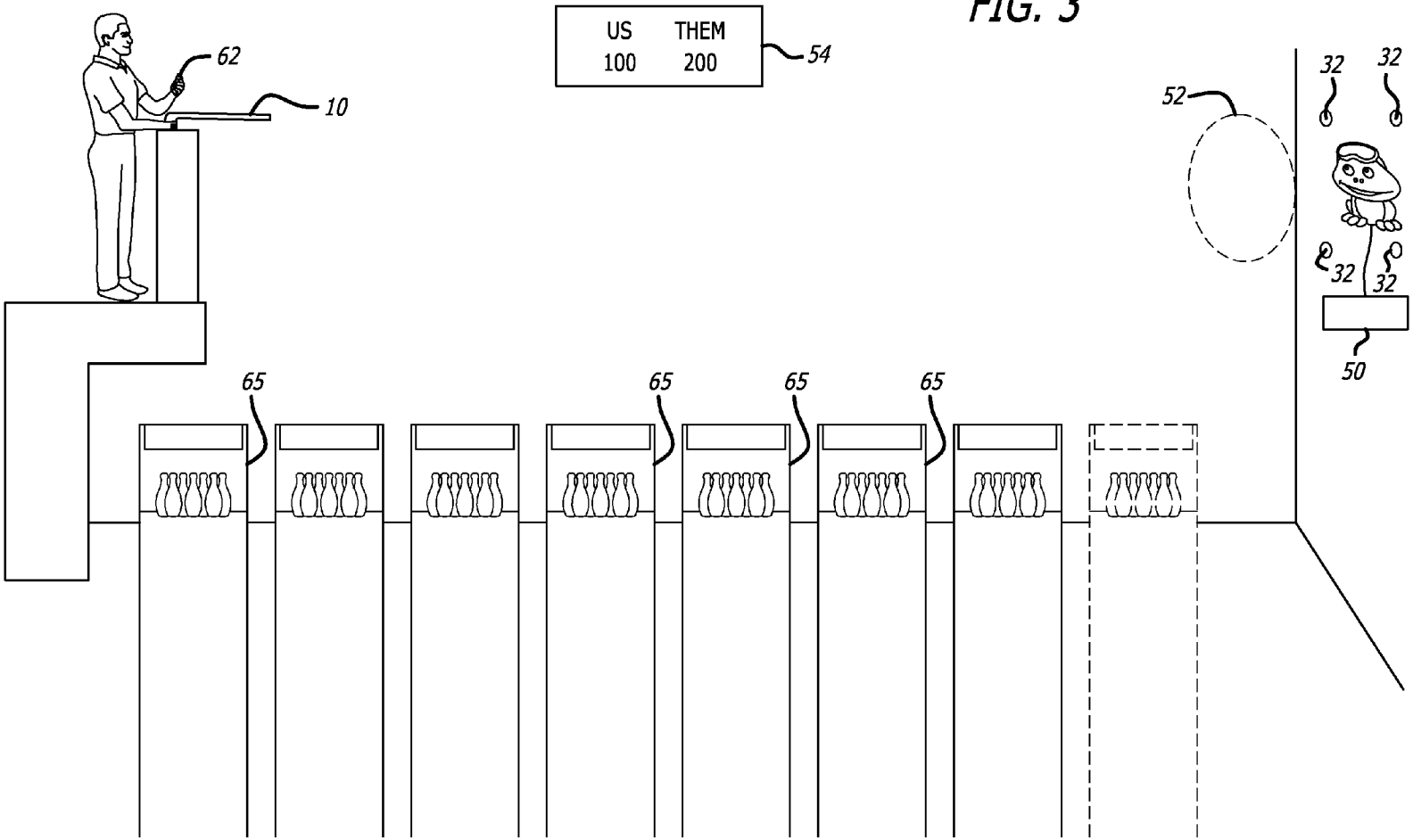
FIG. 3 is a schematic of the shooting gallery of the present invention.

FIG. 3 illustrates one embodiment of the long range shooting gallery of the present invention. A player operates a laser pulse emitting gun 10 at a first end of a large indoor facility, and a target 30 is positioned at an opposite end. The target 30 can take many forms, and is not limited to any particular shape or style. The target may be surrounded by a plurality of infrared emitters 32 that form a shooting window 52 framed by the emitters such that the gun 10 will only fire if the gun's receiver 36 receives a signal from the emitters 32, which in turn defines the shooting window 52. If the gun 10 is aimed outside the window 52, no infrared light from the emitters 32 will reach the receiver 36 and the circuit in the gun will not be closed, preventing the gun from firing. The target is connected to a computer 50 that includes a processor and a transmitter for sending out signals corresponding to activity at the target such as hits, misses, and the like. The information can be relayed to a scoreboard 54, wirelessly communicated to a hand held unit 62, or to some other location where the information can be displayed or retrieved. The benefit of the shooting gallery of the present invention is that it can exist over indoor space being utilized for other purposes, such as bowling lanes 65, arcades, and the like.

The foregoing descriptions and illustrations are not intended to be restrictive or limiting of the present invention, which can be altered or varied in many ways while remaining true to the spirit of the invention.

I claim:

1. A long range indoor shooting gallery, comprising a gun having a barrel and a trigger, and a laser for emitting a laser pulse toward a distant target;

a target that receives the laser pulse from the gun, and generates a signal in response to reception of the laser pulse;

a computer connected to the target and in communication therewith for receiving the signal;

a display for displaying a successful attempt to shoot the target;

infrared emitters surrounding the target that emit an infrared signal, and a receiver on the gun that receives infrared signals and enables the gun to emit the laser pulse only after receiving said infrared signal; and infrared emitters surrounding the target that emit an infrared signal, and a receiver on the gun that receives infrared signals and enables the gun to emit the laser pulse only after receiving said infrared signal.

2. The long range indoor shooting gallery of claim 1, wherein the gun includes a solenoid with an extending pin that engages the laser when the trigger is actuated.

3. The long range indoor shooting gallery of claim 1, wherein the gun includes an electrical circuit and a switch that completes the circuit when the trigger is actuated.

4. The long range indoor shooting gallery of claim 1, wherein the gun is coupled to a direct current power supply.

5. The long range indoor shooting gallery of claim 1, further comprising a scoreboard that communicates with the computer to indicate a score of a player.

6. The long range indoor shooting gallery of claim 1, further comprising a handheld device for displaying a result of the shooting operation.

7. The long range indoor shooting gallery of claim 1, wherein an audio response is generated when a laser pulse strikes the target.

8. The long range indoor shooting gallery of claim 1, wherein a video response is generated when a laser pulse strikes the target.

9. The long range indoor shooting gallery of claim 1, wherein the infrared emitters establish a window through which the barrel must be aimed to permit the gun to emit a laser pulse.

10. The long range indoor shooting gallery of claim 1, wherein a mirror is used to extend a perceived distance between the gun and the target.

* * * * *